US011491378B2

(12) United States Patent
Yi et al.

(10) Patent No.: US 11,491,378 B2
(45) Date of Patent: Nov. 8, 2022

(54) GOLF PUTTER HEAD AND METHOD FOR MANUFACTURING THE SAME, AND GOLF PUTTER

(71) Applicant: Tat Wong, Kowloon (CN)

(72) Inventors: Fucheng Yi, Beiliu (CN); Guangfu Yi, Beiliu (CN)

(73) Assignee: Tat Wong, Hong Kong (CN)

( * ) Notice: Subject to any disclaimer, the term of this patent is extended or adjusted under 35 U.S.C. 154(b) by 326 days.

(21) Appl. No.: 16/412,062

(22) Filed: May 14, 2019

(65) Prior Publication Data

US 2020/0197766 A1 Jun. 25, 2020

(30) Foreign Application Priority Data

Dec. 25, 2018 (CN) ..... 201811593453.4

(51) Int. Cl.

| | |
|---|---|
| ***A63B 53/04*** | (2015.01) |
| ***C21D 1/18*** | (2006.01) |
| ***C21D 9/00*** | (2006.01) |

(52) U.S. Cl.

CPC ..... *A63B 53/0487* (2013.01); *C21D 1/18* (2013.01); *C21D 9/0068* (2013.01); *C21D 2221/00* (2013.01)

(58) Field of Classification Search

CPC .... A63B 53/0487; A63B 53/065; C21D 1/18; C21D 9/0068; C21D 2221/00; C21D 2221/01

See application file for complete search history.

(56) References Cited

U.S. PATENT DOCUMENTS

| | | | | |
|---|---|---|---|---|
| 2004/0092334 | A1* | 5/2004 | Yamamoto | A63B 60/00 148/542 |
| 2008/0102984 | A1 | 5/2008 | Chiang | |
| 2015/0072804 | A1* | 3/2015 | Doi | C21D 9/0068 473/345 |
| 2016/0376676 | A1* | 12/2016 | Chiu | C21D 6/005 148/580 |
| 2018/0189758 | A1* | 7/2018 | Beach | A63B 53/04 |

FOREIGN PATENT DOCUMENTS

| | | | |
|---|---|---|---|
| CN | 101264379 | A | 9/2008 |
| JP | 2004195106 | A * | 7/2004 |

OTHER PUBLICATIONS

The State Intellectual Property Office of People's Republic of China, First Office Action for Chinese Application No. 201811593453.4, dated Feb. 21, 2020, 18 pages.

The State Intellectual Property Office of People's Republic of China, Second Office Action for Chinese Application No. 201811593453.4, dated Nov. 3, 2020, 26 pages.

* cited by examiner

*Primary Examiner* — Anthony J Zimmer
*Assistant Examiner* — Jacob J Gusewelle
(74) *Attorney, Agent, or Firm* — Greensfelder, Hemker & Gale, P.C.; Richard C. Himelhoch

(57) ABSTRACT

Disclosed are a golf putter head having high fault tolerance and a method for manufacturing the same, and a golf putter with the head. The method for manufacturing the golf putter head includes: taking or manufacturing a head body including a ball hitting panel portion, and the ball hitting panel portion including a toe portion, a middle portion, and a heel portion; performing a solution treatment on the ball hitting panel portion; and quenching the toe portion and the heel portion.

9 Claims, 4 Drawing Sheets

GOLF PUTTER HEAD AND METHOD FOR MANUFACTURING THE SAME, AND GOLF PUTTER

CROSS-REFERENCE TO RELATED APPLICATIONS

The present invention claims priority to and the benefit of Chinese Patent Application No. 201811593453.4 filed Dec. 25, 2018, the contents of which are incorporated herein by reference.

FEDERALLY SPONSORED RESEARCH OR DEVELOPMENT

N/A

FIELD OF THE INVENTION

The disclosure relates to golf equipment, and in particular, to a golf putter head and a method for manufacturing the same, and a golf putter.

BACKGROUND

In the golf sport, a golfer first uses a driver and an iron pole to hit a golf ball to the putting green, and then rolls the golf ball into a hole through a putter. Affected by the surface flatness, soil moisture, grass mat thickness, grass species, and the like of the putting green, the golf ball has a fast ball speed when rolling on the putting green. Therefore, to smoothly roll the golf ball into the hole, enjoy the sport, and win the game, the putter needs to have good stability and fault tolerance to achieve precise ball control.

After nine kinds of common putters available on the market (including three kinds of blade putters, three kinds of mallet putters, and three kinds of high moment of inertia putters) are tested, it is found that head weights, head face techniques, and hitting portions jointly affect a conversion rate, and different hitting portions may lead to different golf ball speeds and different movement distances after the hitting. FIG. 1 is a schematic view of a movement distance of a ball after a common golf putter hits the ball. As shown in FIG. 1, in an ideal state, a middle portion of a ball hitting panel 20 of a putter hits a golf ball 5, and then the golf ball 5 moves a distance to reach an ideal stopping point 40. However, in an actual hitting process, due to a golfer's operation, it is possible that either of two sides (a heel portion or a toe portion) of the ball hitting panel 20, rather than a sweet spot in the middle portion, hits the golf ball 5. In this case, a movement direction and a movement distance of the golf ball 5 are changed, and the golf ball 5 may eventually reach a first stopping point 41 or a second stopping point 42. It can be seen that a major mistake resulting from "a little error leading to a large discrepancy" easily occurs in the hitting process, thus affecting the performance of skills. Consequently, fault tolerance is very small in the actual hitting process.

For the foregoing problem, a solution of embedding another material in a middle portion of a putter is proposed in the industry. The solution includes embedding copper, aluminum, plastic, or another similar material in the middle portion of the putter. However, when a golf putter using such material as an embedded portion is used, another problem is found during actual testing. FIG. 2 is a schematic view of a movement distance of a ball after an embedded type putter hits the ball. As shown in FIG. 2, after an embedded portion in a middle portion of a ball hitting panel 20 hits a golf ball 5, the golf ball 5 may move to reach a third stopping point 43, while after either of two sides of the ball hitting panel 20 hits the golf ball 5, the golf ball 5 may move to reach a fourth stopping point 44 or a fifth stopping point 45. When the ball is hit by different portions of the ball hitting panel, there is still a great difference between movement distances of the ball, the dispersion is excessively high, and the movement distance is not stable enough. Obviously, this type of putter still imposes a very high requirement on a golfer's level of ball control, and fault tolerance is very low.

Therefore, it is necessary to provide a method for manufacturing a golf putter head having high fault tolerance and stability and a corresponding golf putter head.

SUMMARY OF THE INVENTION

The technical problem to be solved by the disclosure is how to provide a golf putter head having high fault tolerance and a method for manufacturing the same, and a golf putter with the head.

According to a first aspect of the disclosure, there is provided a method for manufacturing a golf putter head comprising:

providing, taking or manufacturing a head body comprising a ball hitting panel portion, and the ball hitting panel portion comprising a toe portion, a middle portion, and a heel portion;

conducting a solution treatment on the ball hitting panel portion; and quenching the toe portion and the heel portion.

Preferably, the step of conducting a solution treatment on the ball hitting panel portion further includes an aging treatment after the solution treatment.

Further preferably, the aging treatment is 4-24 hours.

Preferably, the head body is made of metal, specifically, it may be a pure metal, a metal alloy, or an intermetallic compound. For example, the metal may be selected from the group consisting of titanium, titanium alloy, stainless steel, carbon steel, aluminum, aluminum alloy, nickel, nickel titanium alloy.

Further preferably, the metal is selected from at least one of stainless steel and carbon steel.

Even further preferably, the metal is stainless steel, the step of quenching the toe portion and the heel portion is conducted at 1000-1100° C., and specifically at 1000° C., 1010° C., 1020° C., 1030° C., 1040° C., 1050° C., 1060° C., 1070° C., 1080° C., 1090° C., 1100° C.

Even further preferably, the metal is carbon steel, the step of quenching the toe portion and the heel portion is conducted at 700-900° C., and specifically at 700° C., 720° C., 740° C., 760° C., 780° C., 800° C., 820° C., 840° C., 860° C., 880° C., 900° C.

Preferably, the step of quenching the toe portion and the heel portion includes rapidly cooling the toe portion and the heel portion after the toe portion and the heel portion are heated in a high-frequency manner.

According to a second aspect of the disclosure, there is provided a golf putter head, manufactured by using the foregoing manufacturing method.

According to a third aspect of the disclosure, there is provided a golf putter, including the foregoing golf putter head.

The beneficial effects of the disclosure are as follows:

In the disclosure, the putter head is manufactured by, first changing a molecular structure and a crystal phase of the material by a solid solution process so as to reduce hardness of the entire ball hitting panel portion, and then quenching the heel portion and the toe portion to improve surface hardness of the toe portion and the heel portion again, so that hardness of two sides of an entire ball hitting surface of the putter is obviously higher than that of a middle portion, and a particular hardness gradient distribution is presented from the two sides to the middle portion. When the putter is swung to roll a ball, if the golf ball touches the toe portion or the heel portion of the ball hitting surface, the ball may have a tendency and process of moving towards the middle of the ball hitting surface. In this process, not all power of the golf ball comes from rebound force generated by interaction force at the moment of contact, but more power comes from force of the swing, and impact force increases after the heel portion or the toe portion functions. The obtained speed of the golf ball is increased, and a loss in the distance during ball rolling is greatly reduced, that is, hitting by the heel portion or the toe portion does not cause too many losses in the distance compared with hitting by the middle portion, and therefore, fault tolerance of the putter can be improved.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings and attachments in which.

DETAILED DESCRIPTION

The concept, the specific structure, and the technical effects of the disclosure will be clearly and completely described below with reference to the embodiments, to fully understand the objectives, features, and effects of the disclosure. Apparently, the described embodiments are only some embodiments of the disclosure, rather than all of the embodiments. Other embodiments obtained by those skilled in the art based on the embodiments of the disclosure without creative efforts shall fall within the protection scope of the disclosure. In addition, all coupling/connection relationships involved in the patent application do not mean that components are directly connected only, but also mean that a coupling accessory may be added or reduced based on a specific implementation status, to form a better coupling structure. Various technical features of the disclosure can be mutually combined in the case of no conflict.

Embodiment 1

Figure 1:
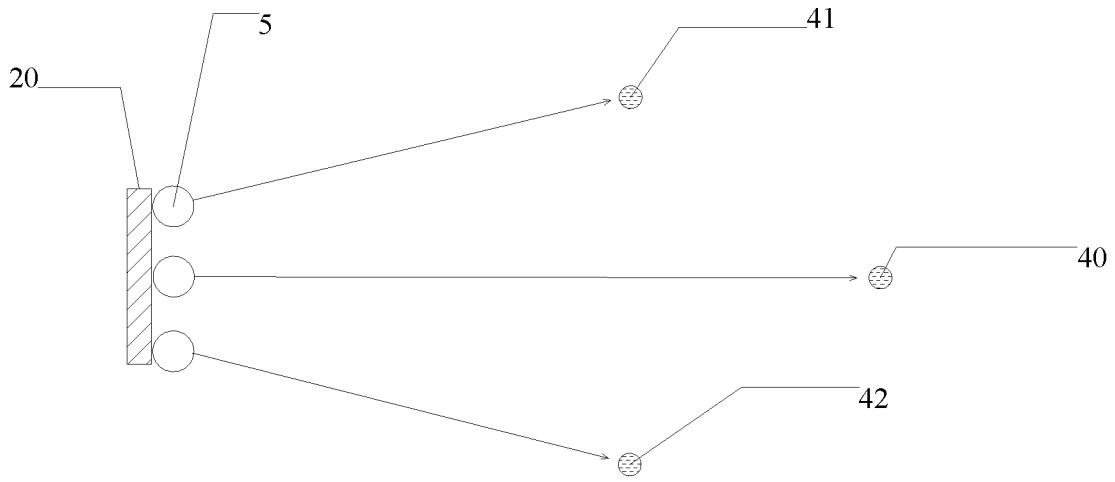
FIG. 1 is a schematic view of a movement distance of a ball after a common golf putter hits the ball.
Figure 3:
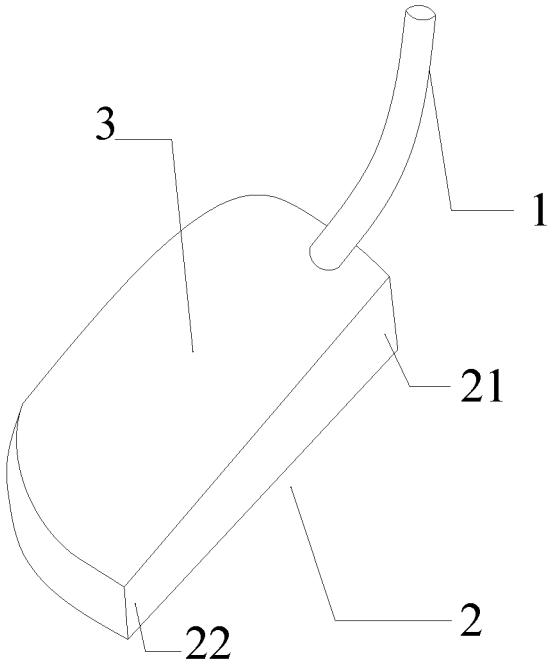
FIG. 3 is a schematic view of a golf putter head according to an embodiment of the disclosure.

A method for manufacturing a golf putter head includes a forging step, a solution treatment step, and a quenching treatment step of a head body. The steps are specifically as follows:

(1) Manufacturing of the Head Body:

FIG. 3 is a schematic view of a head body of a golf putter head according to an embodiment of the disclosure. A 303 stainless steel bar is selected and is sequentially subjected to rough forging, medium forging, and fine forging at a temperature of 800-1000° C., to obtain a head body. The head body has a shape shown in FIG. 1. In other words, the head body includes a vertical ball hitting panel portion 2 and a rod body 1 located at a corner of a top surface of the head body. The ball hitting panel portion 2 is a vertical plane, and the rod body 1 is used to connect to the putter, so that a user holds the putter with hands and hits a ball. The top surface 3 of the head body is of a shape of an approximately rounded rectangle. The ball hitting panel portion 2 is provided with a heel portion 21 adjacent to the rod body 1, a toe portion 22 located opposite the heel portion 21 and away from the rod body 1, and a middle portion located between the heel portion 21 and the toe portion 22.

(2) Solution Treatment:

The head body manufactured in step 1 is heated in a vacuum furnace body to 1040° C. and then heat preservation treatment is conducted for 3 hours. After temperature in the furnace body is lowered to 300° C., nitrogen is introduced to the vacuum furnace for rapid cooling to a normal temperature and then the head body is taken out.

(3) Quenching Treatment:

High-frequency treatment is conducted on the toe portion 22 and the heel portion 21 at 1040° C. for 6 seconds. After the treatment is completed, the toe portion 22 and the heel portion 21 may be rapidly cooled for 5-30 seconds through spraying using a sprayer. Water or oil at 5-40° C., or other fluid having a relatively low temperature, may be sprayed.

Through the foregoing steps, a putter head with hardness gradually increasing from the middle portion of the ball hitting panel at which the hardness is relatively low to either side of the ball hitting panel at which the hardness is relatively high, as required in the disclosure, can be obtained. After a suitable putter is assembled on the rod body 1, a golf putter with high stability and fault tolerance is obtained.

Embodiment 2

Figure 2:
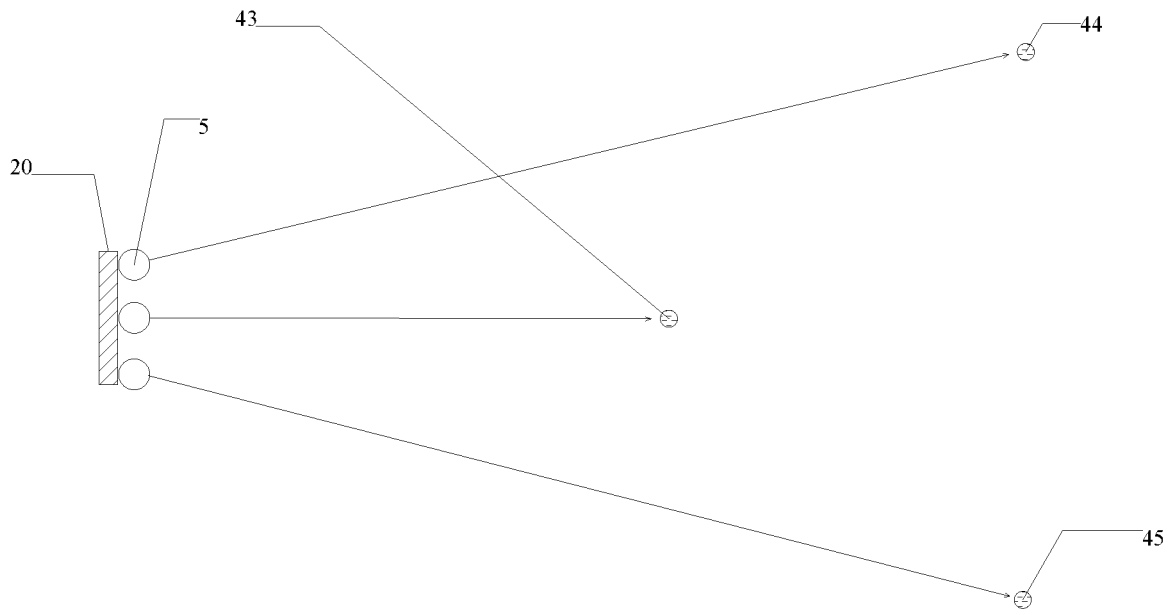
FIG. 2 is a schematic view of a movement distance of a ball after an embedded type putter hits the ball.
Figure 4:
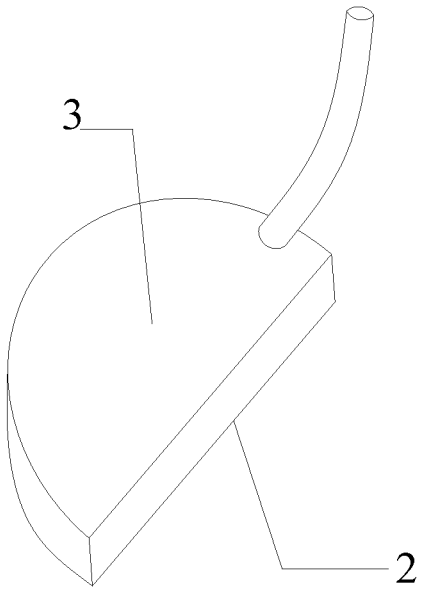
FIG. 4 is a schematic view of a golf putter head according to another embodiment of the disclosure.

There is provided a method for manufacturing a golf putter head which is different from Embodiment 1 in that the head body of the putter is made of 304 stainless steel. FIG. 4 is a schematic view of a golf putter head according to another embodiment of the disclosure. As shown in FIG. 2, during manufacturing of a head body, the head body is manufactured into a semi-cylindrical shape. In other words, the golf putter head body has a top surface 3 of semi-circular shape, and a side face including a rectangular ball hitting panel portion 2 and a cambered surface.

Embodiment 3

There is provided a method for manufacturing a golf putter head which is different from Embodiment 1 in that the head body of the putter is made of carbon steel. The putter head is subjected to heat preservation treatment at a temperature of about 750° C. for 3 hours, and water at a room temperature is directly sprayed for 30 seconds for rapid cooling and quenching.

Embodiment 4

There is provided a golf putter head which is different from Embodiment 1 in that the head body of the putter is made of spring steel, and the head body is a flat triangular prism and is quenched at 1000° C.

Embodiment 5

There is provided a golf putter head which is different from Embodiment 1 in that the head body is of a strip shape.

Embodiment 6

There is provided a golf putter head which is different from Embodiment 1 in that the top surface of the head body is of a shape of trapezoidal or inversely trapezoidal quadrangular prism.

Embodiment 7

There is provided a golf putter head which is different from Embodiment 1 in that the top surface of the head body is of a fork shape.

Embodiment 8

Comparative Test

The golf putter heads manufactured in Embodiments 1-3 are used to obtain golf putters, and three commercially available golf putters (PING Oslo, TaylorMade Spider Tour, and Odyssey works #1) are used as reference examples 1-3 to conduct comparative tests to test data of a ball speed, a conversion rate, and a conversion rate decline rate when the putters hit a golf ball at a putting green speed of 8 and a club speed of 3.65±0.04 mph. Multiple groups of repeated tests are conducted, and results are shown in the following table:

Many modifications and variations of the present invention are possible in light of the above teachings. It is, therefore, to be understood within the scope of the appended claims the invention may be protected otherwise than as specifically described.

TABLE 1

Comparative test results

| | Embodiment 1 | Embodiment 2 | Embodiment 3 | Reference example 1 | Reference example 2 | Reference example 3 |
|---|---|---|---|---|---|---|
| Club speed | | | 3.65 ± 0.04 | | | |
| Ball speed 1 | 6.01 ± 0.02 | 6.11 ± 0.06 | 5.83 ± 0.07 | 5.95 ± 0.01 | 5.51 ± 0.01 | 5.73 ± 0.01 |
| Conversion rate 1 | 1.64 ± 0.06 | 1.67 ± 0.03 | 1.59 ± 0.07 | 1.63 ± 0.03 | 1.51 ± 0.05 | 1.57 ± 0.04 |
| Ball speed 2 | 6.02 ± 0.02 | 6.13 ± 0.02 | 5.87 ± 0.06 | 6.23 ± 0.08 | 5.90 ± 0.07 | 6.05 ± 0.09 |
| Conversion rate 2 | 1.65 ± 0.03 | 1.68 ± 0.06 | 1.61 ± 0.03 | 1.72 ± 0.03 | 1.63 ± 0.03 | 1.64 ± 0.02 |
| Conversion rate decline rate | 0.007% | 0.013% | 0.015% | 5% | 7% | 4% |

Wherein, the ball speed 1 is a ball speed when the ball is hit by a middle portion of a putter, a conversion rate 1 is a ratio of the ball speed 1 to the club speed, the ball speed 2 is a ball speed when the ball is hit by a toe portion or a heel portion of the putter, and a conversion rate 2 is a ratio of the ball speed 2 to the club speed. The conversion rate decline rate is equal to (conversion rate 1−conversion rate 2)/conversion rate 1×100%, and is used to characterize a difference between final movement distances of the ball when the ball is hit by different portions of the putter. When the decline rate is closer to 0, it indicates that a difference in a ball hitting portion of the putter has a smaller impact on movement of the ball, and fault tolerance of the putter is also better.

As can be seen from the results in the foregoing table, the conversion rate decline rates of the existing products are at least 4%, and even reach 7%. For a 6-yard (20-foot) ball hitting distance, a final error may be as much as ±1 yard (3 feet). This is apparently unacceptable for golfers who are seeking for stability in performance and accurate ball control. The conversion rate decline rates of the golf putters manufactured in the embodiments during the test are almost zero. In other words, the movement distance of the ball is not changed regardless of whether the ball is hit by the middle portion, the toe portion, or the heel portion of the putter. No loss in the distance occurs when the ball is hit by different portions of the putter. The putters in the embodiments, when used to hit the ball, have higher stability and fault tolerance, so that the golfer can achieve precise ball control.

Embodiment 9

There is provided a method for manufacturing a golf putter head which is different from Embodiment 1 in that the head body of the putter is made of titanium alloy.

Preferred embodiments of the disclosure are specifically illustrated above, but the disclosure is not limited to the embodiments. Those skilled in the art may also make various equivalent modifications or replacements without departing from the scope of the disclosure, and these equivalent modifications or replacements shall all fall within the scope defined by the claims of the application.

We claim:

1. A method for manufacturing a golf putter head, comprising:

providing a golf putter head body comprising a ball hitting panel portion and a rod body located at a corner of a top surface of the golf putter head body, the golf putter head body being made of metal, the ball hitting panel portion comprising a heel portion adjacent to the rod body, a toe portion located opposite the heel portion and away from the rod body, and a middle portion located between the toe portion and the heel portion;

conducting a solution treatment on the ball hitting panel portion, heating the ball hitting panel portion in a vacuum furnace body to 1040° C. and then conducting a heat preservation treatment for 3 hours, after temperature in the furnace body is lowered to 300° C. introducing nitrogen to the vacuum furnace for cooling; and quenching the toe portion and the heel portion comprising cooling the toe portion and the heel portion after the toe portion and the heel portion being heated.

2. The method for manufacturing a golf putter head according to claim 1, wherein the step of conducting a solution treatment on the ball hitting panel portion further comprises an aging treatment after the solution treatment.

3. The method for manufacturing a golf putter head according to claim 2, wherein the aging treatment is 4-24 hours.

4. The method for manufacturing a golf putter head according to claim 1, wherein the metal is selected from at least one of stainless steel and carbon steel.

5. The method for manufacturing a golf putter head according to claim 4, wherein the metal is stainless steel, and the step of quenching the toe portion and the heel portion is conducted at 1000-1100° C.

6. The method for manufacturing a golf putter head according to claim 4, wherein the metal is carbon steel, and the step of quenching the toe portion and the heel portion is conducted at 700-900° C.

7. The method for manufacturing a golf putter head according to claim 1, wherein the step of providing a head body comprising a ball hitting panel portion includes manufacturing a head body comprising a ball hitting panel portion.

8. A golf putter head, wherein the golf putter head is manufactured by using the manufacturing method according to claim 1.

9. A golf putter, comprising the golf putter head according to claim 8.

* * * * *